US007975473B2

(12) United States Patent
Marotta et al.

(10) Patent No.: US 7,975,473 B2
(45) Date of Patent: Jul. 12, 2011

(54) EXHAUST MANIFOLD ASSEMBLY

(75) Inventors: Kenneth L. Marotta, Macomb, MI (US); Robert H. Beck, East China, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 807 days.

(21) Appl. No.: 11/869,812

(22) Filed: Oct. 10, 2007

(65) Prior Publication Data

US 2009/0094969 A1 Apr. 16, 2009

(51) Int. Cl.
*F01N 1/00* (2006.01)

(52) U.S. Cl. ..... 60/324; 60/274; 60/305; 60/322; 60/323

(58) Field of Classification Search ..... 60/272, 60/305, 322, 323, 324
See application file for complete search history.

(56) References Cited

U.S. PATENT DOCUMENTS

| | | | | |
|---|---|---|---|---|
| 4,796,426 | A * | 1/1989 | Feuling | 60/313 |
| 5,636,515 | A * | 6/1997 | Matsumoto et al. | 60/323 |
| 5,729,975 | A * | 3/1998 | Bekkering | 60/323 |
| 5,867,985 | A * | 2/1999 | Furuhashi et al. | 60/323 |
| 6,425,243 | B1 * | 7/2002 | Chen et al. | 60/323 |
| 6,581,377 | B2 * | 6/2003 | Carlson et al. | 60/323 |
| 6,651,425 | B2 * | 11/2003 | Kenyon et al. | 60/323 |
| 7,231,762 | B2 * | 6/2007 | Bassani | 60/323 |

FOREIGN PATENT DOCUMENTS

| | | | |
|---|---|---|---|
| EP | 1229221 | A1 | 8/2002 |
| EP | 1365121 | A1 | 11/2003 |
| JP | 2004225663 | A | 8/2004 |
| JP | 2007024024 | A | 2/2007 |

* cited by examiner

*Primary Examiner* — Binh Q Tran
(74) *Attorney, Agent, or Firm* — Harness, Dickey & Pierce, P.L.C.

(57) ABSTRACT

An exhaust manifold may include a manifold body and a flange. The manifold body may include a first tube that forms an exhaust gas inlet. The flange may be coupled to the manifold body and may fix the manifold body to an engine. The flange may include a first aperture having first and second portions located along an axial extent of the first aperture. The first portion may extend to a first end surface of the flange and the second portion may extend to a second end surface of the flange. The first portion may have a first radial width that is less than a second radial width of the second portion. The second portion may receive an end of the first tube therein. The first tube may be fixed to the flange at a location within the first aperture between the first portion and the second end surface.

19 Claims, 3 Drawing Sheets

EXHAUST MANIFOLD ASSEMBLY

FIELD

The present disclosure relates to exhaust manifolds, and more specifically to engagement between a mounting flange and a manifold body of an exhaust manifold.

BACKGROUND

The statements in this section merely provide background information related to the present disclosure and may not constitute prior art.

An engine assembly typically includes an exhaust manifold coupled to an engine to direct an exhaust gas flow therefrom. The exhaust manifold may include a manifold body fixed to a flange that couples the exhaust manifold to the engine. The manifold body may be welded to the flange generally at an end surface thereof that generally abuts the engine after assembly. The manifold body and flange are typically formed from similar materials to account for the thermal expansion experienced during the welding process.

SUMMARY

An exhaust manifold may include a manifold body and a flange. The manifold body may include a first tube that forms an exhaust gas inlet. The flange may be coupled to the manifold body and may fix the manifold body to an engine and place the manifold body in communication with an exhaust gas from the engine. The flange may include a first aperture having first and second portions located along an axial extent of the first aperture. The first portion may extend to a first end surface of the flange and the second portion may extend to a second end surface of the flange. The first portion may have a first radial width that is less than a second radial width of the second portion. The second portion may receive an end of the first tube therein. The first tube may be fixed to the flange at a location within the first aperture between the first portion and the second end surface.

A method may include inserting an end of a first tube that forms an exhaust gas inlet to an exhaust manifold into a first aperture of a flange that mounts the exhaust manifold to an engine. The first aperture may include first and second portions located along an axial extent of the first aperture. The first portion may extend to a first end surface of the flange and the second portion may extend to a second end surface of the flange. The first portion may have a first radial width that is less than a second radial width of the second portion. The method may further include aligning the end axially within the first aperture at a location between the first portion and the second end surface and fixing the end of the first tube to an inner surface of the first aperture.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
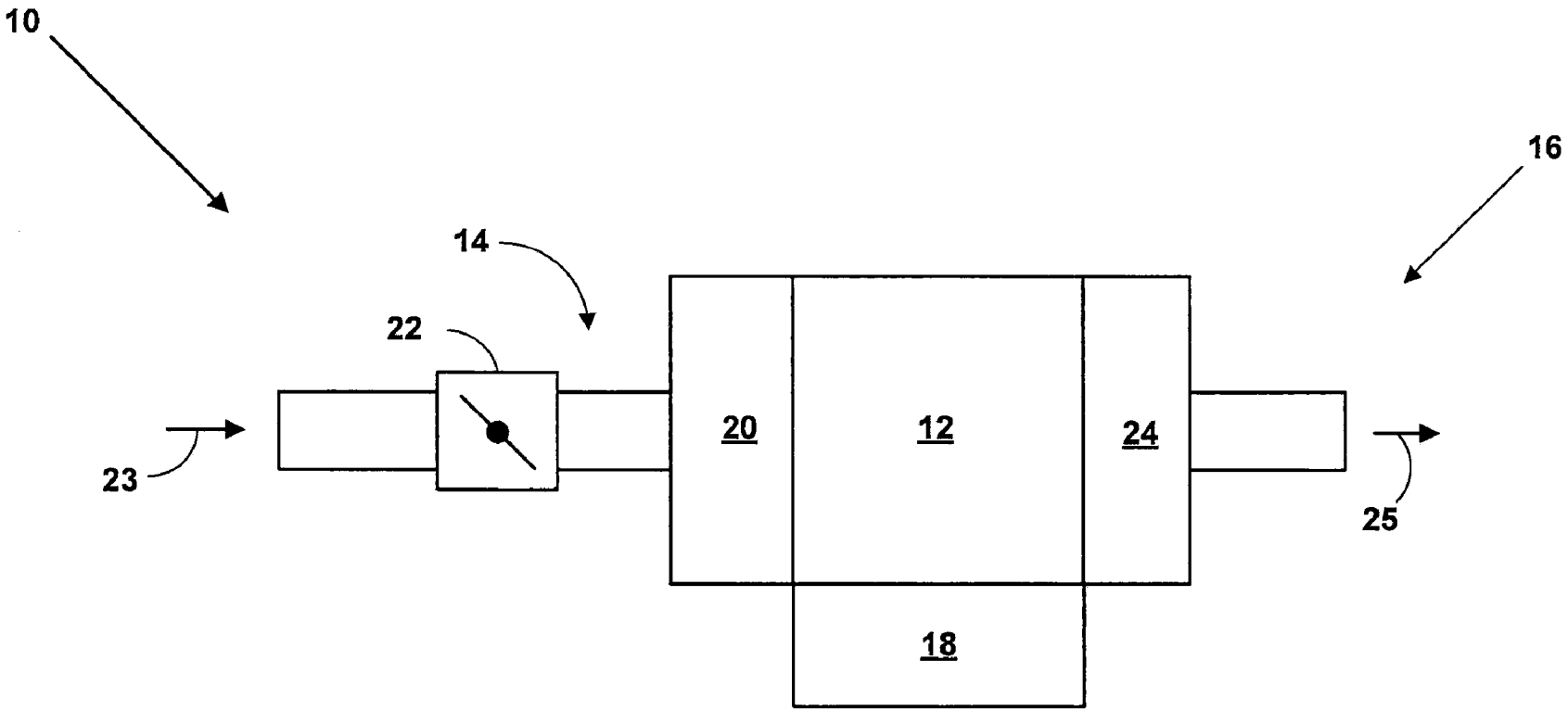
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an exemplary engine assembly 10 is schematically illustrated. Engine assembly 10 may include an engine 12 in communication with an intake system 14, an exhaust system 16, and a fuel system 18. In the example shown, intake system 14 may include an intake manifold 20 and a throttle 22. However, it is understood that alternate applications may not include throttle 22. Throttle 22 may control an air flow (indicated by arrow 23) into engine 12 and fuel system 18 may control a fuel flow into engine 12. Exhaust system 16 may include an exhaust manifold 24 fixed to engine 12 and in communication with exhaust gas created by combustion of the air/fuel mixture. Exhaust manifold 24 may direct an exhaust gas flow (indicated by arrow 25) from engine 12.

Figure 2:
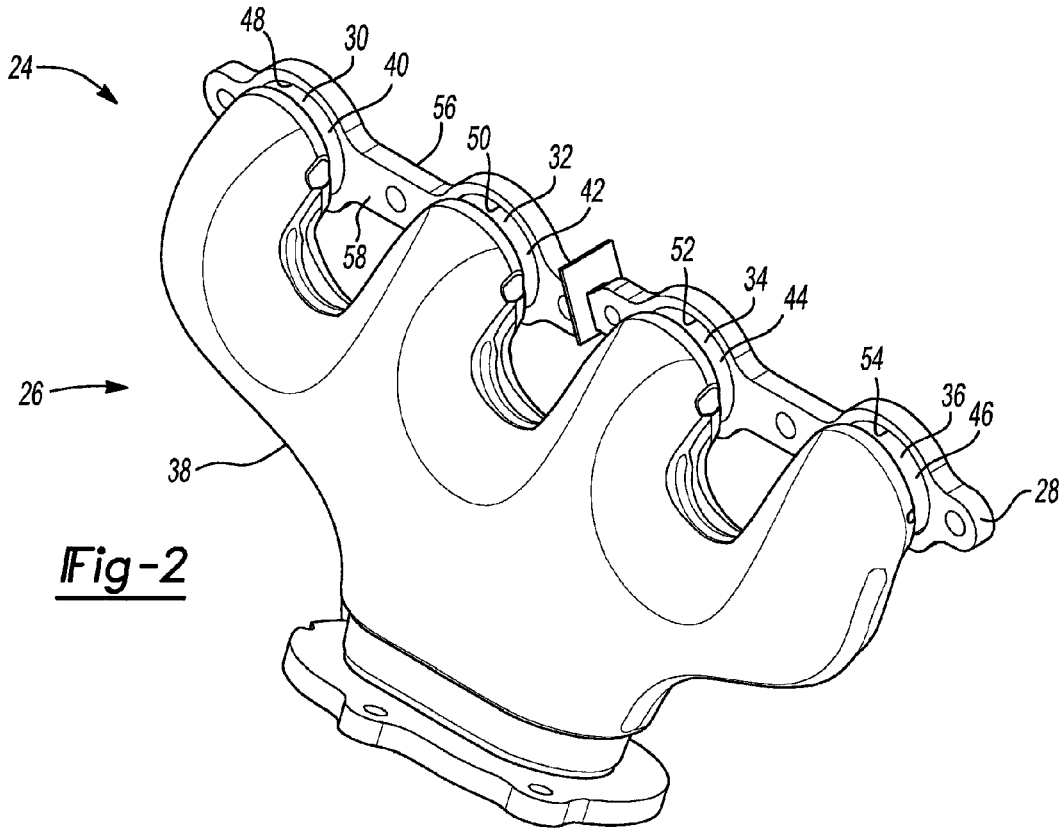
FIG. 2 is a perspective view of an exhaust manifold according to the present disclosure.

With reference to FIG. 2, exhaust manifold 24 may include a manifold body 26 and a flange 28. Manifold body 26 may include, but is not limited to, a series of tubes 30, 32, 34, 36 having a jacket 38 fixed thereto. Tubes 30, 32, 34, 36 may be fixed relative to one another by engagement with jacket 38. More specifically, each of tubes 30, 32, 34, 36 may be welded to jacket 38. Tubes 30, 32, 34, 36 may be formed from a variety of materials including steel, such as wrought low-carbon and stainless steels. Ends 40, 42, 44, 46 of each of tubes 30, 32, 34, 36 may extend beyond jacket 38. Due to manufacturing variation, the extent of ends 40, 42, 44, 46 beyond jacket 38 may vary among tubes 30, 32, 34, 36.

Figure 3:
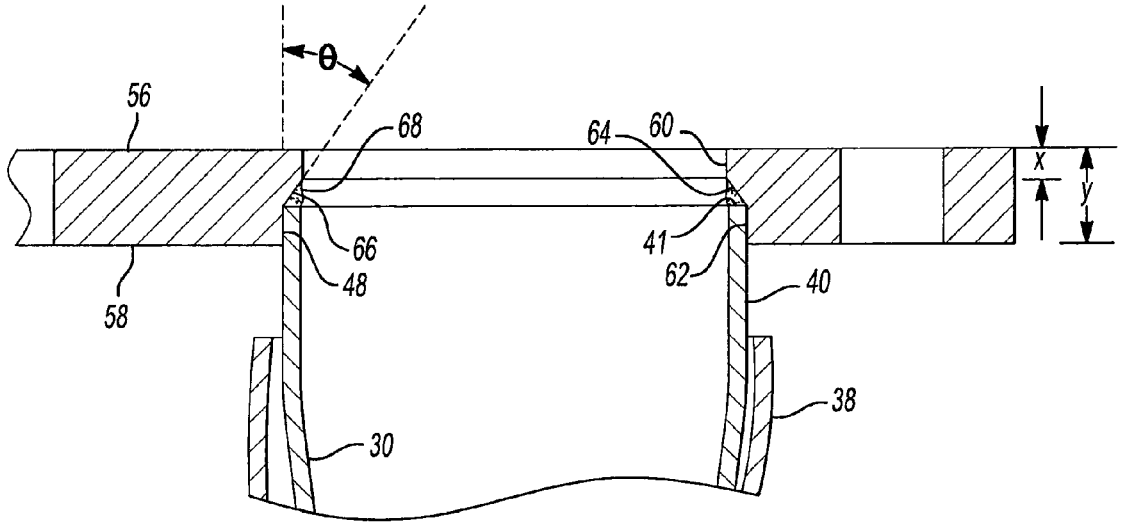
FIG. 3 is a fragmentary sectional view of the exhaust manifold of FIG. 2.

Flange 28 may be formed, for example, from a powdered metal. In this example, tubes 30, 32, 34, 36 and flange 28 may be formed from different materials. Tubes 30, 32, 34, 36 may therefore have a different coefficient of thermal expansion than flange 28. The powdered metal of flange 28 may have a density of at least 6.8 g/cm$^3$. Flange 28 may include a series of apertures 48, 50, 52, 54 extending between first and second end surfaces 56, 58 thereof. First end surface 56 may be a mating surface for engagement with engine 12. With additional reference to FIG. 3, aperture 48 will be described with the understanding that the description applies equally to apertures 50, 52, 54. Aperture 48 may include first and second portions 60, 62 having a stepped region 64 therebetween.

Figure 5:
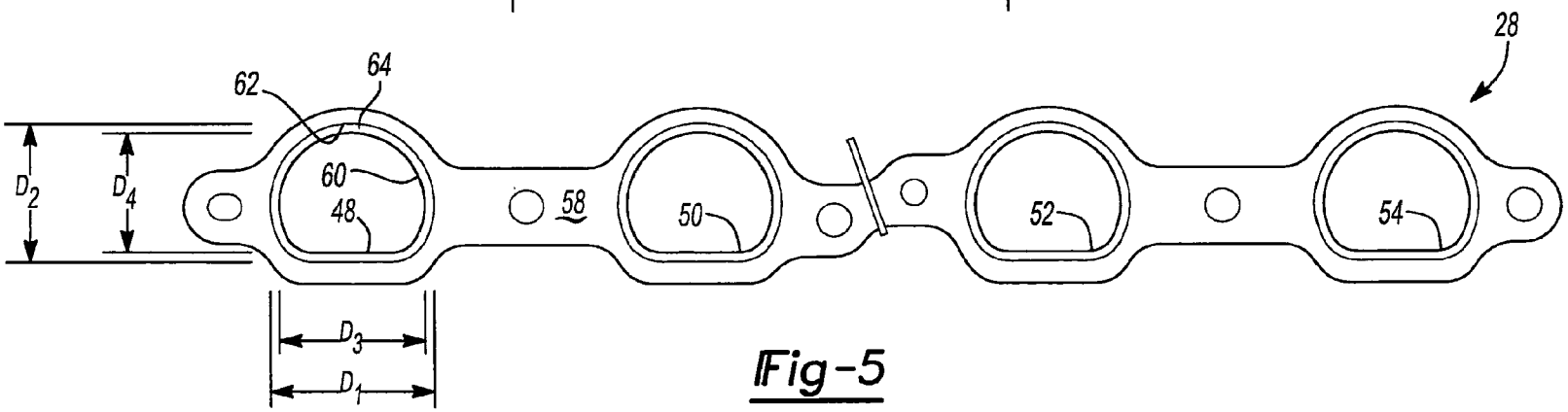
FIG. 5 is a bottom plan view of a flange of the exhaust manifold of FIG. 2.

First portion 60 may extend to first end surface 56 and second portion 62 may extend to second end surface 58. First portion 60 may have a radial width that is less than a radial width of second portion 62. More specifically, and with additional reference to FIG. 5, second portion 62 may extend radially outwardly relative to first portion 60 and may include major and minor diameters (D1, D2) that are greater than major and minor diameters (D3, D4) of first portion 60.

Stepped region 64 may extend at an angle relative to the longitudinal axis of aperture 48. For example, stepped region 64 may extend at an angle (θ) of between 10 and 90 degrees. Alternatively, stepped region 64 may extend at an angle of between 90 and 135 degrees to provide a generally closed recess. Stepped region 64 may be located a distance (x) from first end surface 56 of between 25 and 75 percent of the axial extent (y) of aperture 48. More specifically, stepped region 64 may be located at approximately the midpoint of the axial extent (y) of aperture 48. End 40 of tube 30 may extend into aperture 48 at a location between first end surface 56 and second end surface 58. For example, an end face 41 of end 40 may be located axially between first portion 60 and second end surface 58. It is understood that the description of tube 30 and aperture 48 applies equally to tubes 32, 34, 36 and apertures 50, 52, 54.

Figure 4:
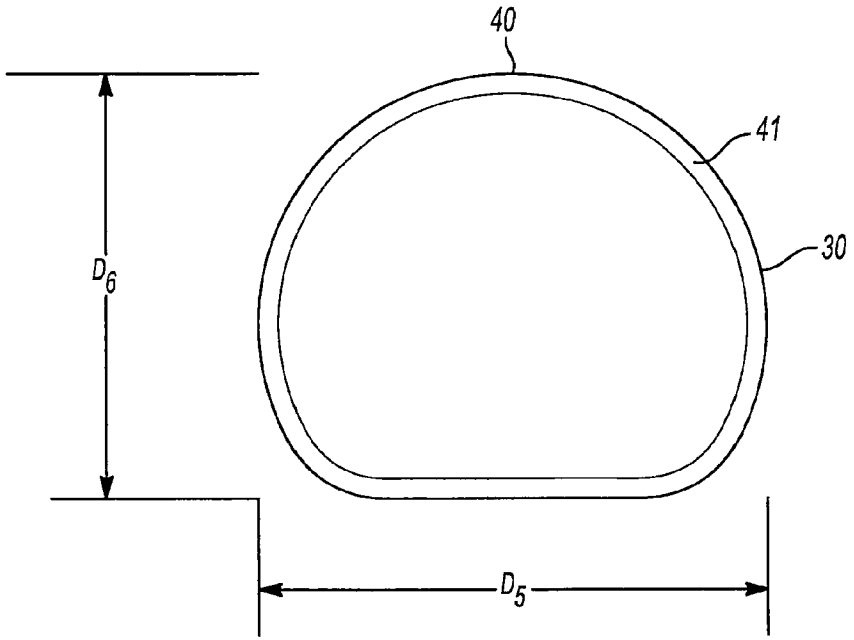
FIG. 4 is a fragmentary plan view of an end of a tube of the exhaust manifold of FIG. 2.

With additional reference to FIG. 4, end face 41 of tube 30 may have a major diameter (D5) that is less than D1 and greater than D3. End face 41 of tube 30 may have a minor diameter (D6) that is less than D2 and greater than D4. As such, stepped region 64 may extend radially over end 40 of tube 30. A recess 66 may be formed between first portion 60 and end 40 of tube 30 and may have an axial extent defined by end face 41 and stepped region 64. Recess 66 may extend radially outwardly relative to an inner surface of tube 30 at end 40 and first portion 60 of aperture 48. The radially outward extent of recess 66 may be between 0.5 mm and 4.0 mm relative to first portion 60. Recess 66 may be located a distance (x) from first end surface 56 of between 25 and 75 percent of the axial extent (y) of aperture 48 (seen in FIG. 3). More specifically, recess 66 may be located at approximately the midpoint of the axial extent (y) of aperture 48.

End 40 of tube 30 may be fixed to an inner wall of aperture 48 at a location between first and second end surfaces 56, 58. For example, end 40 of tube 30 may be fixed to flange 28 at a location between first portion 60 and second end surface 58, and more specifically at recess 66. Due to the fixation of tube 30 within aperture 48 at a location between first and second end surfaces 56, 58, rather than at first end surface 56, the axial extent of tube 30 within aperture 48 may vary without requiring additional machining operations. For example, at least two of tubes 30, 32, 34, 36 may have different axial extents within apertures 48, 50, 52, 54. One of tubes 30, 32, 34, 36 may have an axial extent that is up to 2.0 mm greater than another of tubes 30, 32, 34, 36, and more specifically between 1.0 and 2.0 mm greater than another of tubes 30, 32, 34, 36.

Tube 30 may be fixed to flange 28 by a weld bead 68. A weld tip may be inserted into aperture 48 and may apply weld bead 68 within recess 66. The angular extent of stepped region 64 discussed above may generally facilitate insertion of the weld tip for the welding operation. Weld bead 68 may have a radially inward extent relative to first portion 60 that is, for example, less than or equal to 1 mm. As such, weld bead 68 may provide little or no additional flow restriction within aperture 48. The location of weld bead 68 within recess 66 at a location proximate the midpoint of the axial extent of aperture 48 may generally limit warpage of first end surface 56 that is typically caused by the heat generated during welding. More specifically, warpage of first end surface 56 may be generally less than a warpage caused by welding directly on first end surface 56. The reduced warpage may eliminate or reduce the amount of machining required on first end surface 56.

What is claimed is:

1. An exhaust manifold comprising:

a manifold body including a first tube that forms an exhaust gas inlet; and a flange coupled to said manifold body that fixes said manifold body to an engine and places said manifold body in communication with an exhaust gas from said engine, said flange including a first aperture having first and second portions located along an axial extent of said first aperture, said first portion extending to a first end surface of said flange and said second portion extending to a second end surface of said flange, said first portion having a first radial width that is less than a second radial width of said second portion, said second portion receiving an end of said first tube therein, said first tube being fixed to said flange at a location within said first aperture between said first portion and said second end surface and defining a recess between said end of said first tube and said first portion of said first aperture.

2. The exhaust manifold of claim 1, further comprising a weld bead located on an inner surface of said first aperture and fixing said end of said first tube to said flange.

3. The exhaust manifold of claim 2, wherein said weld bead is disposed in said recess.

4. The exhaust manifold of claim 3, wherein said weld bead extends radially inwardly beyond an inner surface of said first portion less than 1 millimeter.

5. The exhaust manifold of claim 2, wherein said weld bead is located at approximately an axial midpoint of said first aperture.

6. The exhaust manifold of claim 1, wherein said end of said first tube includes a third radial width that is greater than said first radial width.

7. The exhaust manifold of claim 1, wherein said flange includes a stepped region between said first and second portions.

8. The exhaust manifold of claim 7, wherein said stepped region extends at an angle of between 10 and 90 degrees relative to a longitudinal axis of said first aperture.

9. The exhaust manifold of claim 7, wherein said stepped region extends radially over said end of said first tube.

10. The exhaust manifold of claim 7, wherein said manifold body includes a second tube and said flange includes a second aperture having first and second portions along an axial extent thereof with an additional stepped region therebetween, said second tube forming an additional exhaust gas inlet and having an axial extent within said second aperture that is greater than an axial extent of said first tube within said first aperture.

11. The exhaust manifold of claim 1, wherein said first tube and said flange are formed from different materials.

12. The exhaust manifold of claim 11, wherein said flange is formed from a powdered metal.

13. A method comprising:

inserting an end of a first tube that forms an exhaust gas inlet to an exhaust manifold into a first aperture of a flange that mounts said exhaust manifold to an engine, said first aperture including first and second portions located along an axial extent thereof, said first portion extending to a first end surface of said flange and said second portion extending to a second end surface of said flange, said first portion having a first radial width that is less than a second radial width of said second portion;

aligning said end axially within said first aperture at a location between said first portion and said second end surface, said aligning providing a recess between said first portion and said end of said first tube; and fixing said end of said first tube to an inner surface of said first aperture.

14. The method of claim 13, wherein said fixing includes welding.

15. The method of claim 14, wherein said welding includes forming a weld bead on said inner surface of said first aperture at approximately an axial midpoint of said first aperture.

16. The method of claim 13, wherein said first aperture includes a stepped region located between said first and second portions.

17. The method of claim 16, wherein said fixing includes forming a weld bead within said recess.

18. The method of claim 17, wherein said fixing includes inserting a weld tip into said recess to form said weld bead.

19. The method of claim 13, further comprising forming said flange from a powdered metal.

* * * * *